US010481624B2

(12) United States Patent
Tan

(10) Patent No.: US 10,481,624 B2
(45) **Date of Patent: *Nov. 19, 2019**

(54) BANDGAP REFERENCE CIRCUIT

(71) Applicant: PixArt Imaging Inc., Hsin-Chu County (TW)

(72) Inventor: Kok-Siang Tan, Penang (MY)

(73) Assignee: PIXART IMAGING INC., Hsin-Chu County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/377,297

(22) Filed: Apr. 8, 2019

(65) Prior Publication Data

US 2019/0235542 A1 Aug. 1, 2019

Related U.S. Application Data

(63) Continuation of application No. 15/956,190, filed on Apr. 18, 2018, now Pat. No. 10,296,027, which is a continuation of application No. 15/499,497, filed on Apr. 27, 2017, now Pat. No. 9,977,442.

(51) Int. Cl.
*G05F 1/46* (2006.01)

(52) U.S. Cl.
CPC ..... *G05F 1/468* (2013.01)

(58) Field of Classification Search
CPC ..... G05F 1/10; G05F 1/46; G05F 1/468
USPC ..... 323/313; 327/538, 539, 540, 541
See application file for complete search history.

(56) References Cited

U.S. PATENT DOCUMENTS 7,319,314 B1 * 1/2008 Maheshwari ..... G05F 1/46 323/313
2008/0187026 A1 * 8/2008 Ueda ..... G01K 7/015 374/185

* cited by examiner

*Primary Examiner* — William Hernandez
(74) *Attorney, Agent, or Firm* — WPAT, PC

(57) ABSTRACT

A bandgap reference circuit including a clamp circuit is provided. The bandgap reference circuit performs the calibration only for one time in a normal mode to store a control code of a reference generator of the clamp circuit. In a suspend mode, the control code is used for controlling the reference generator to cause the clamp circuit to provide a desired source voltage, and a bandgap reference voltage source is shut down to reduce the power consumption.

20 Claims, 5 Drawing Sheets

| | clamp circuit | SW1 | calibration engine | regulator | bandgap ref. voltage source |
|---|---|---|---|---|---|
| normal | shut down | OFF | idle | turn on | turn on |
| calibration (from normal) | turn on | OFF | activated store (control) code | turn on | turn on |
| low power | turn on | conducted | activated | shut down | shut down |
FIG. 9
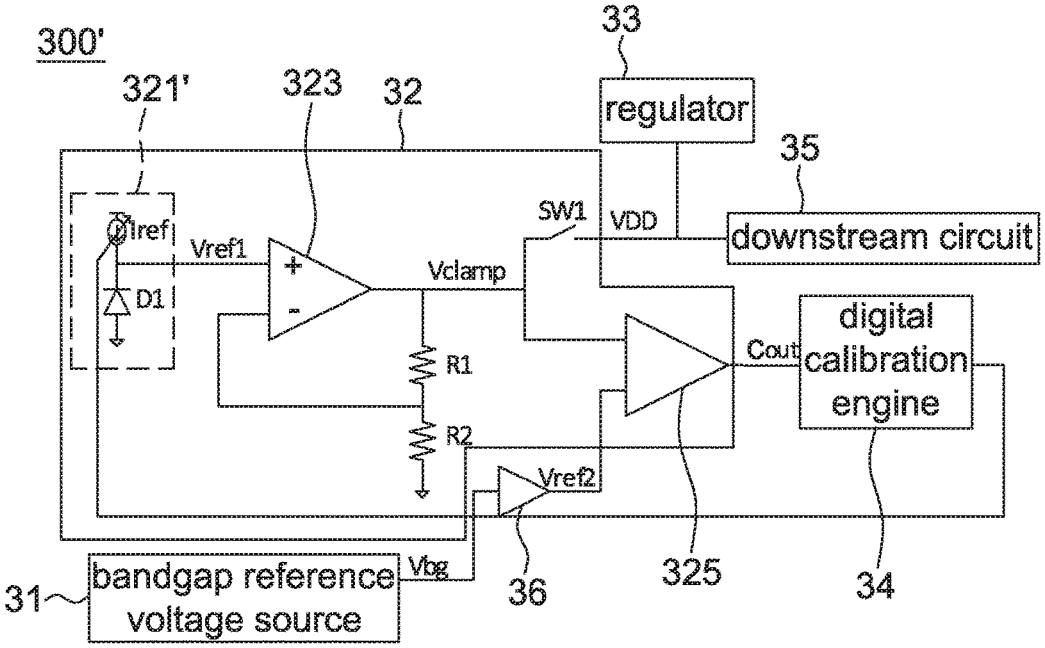
FIG. 10
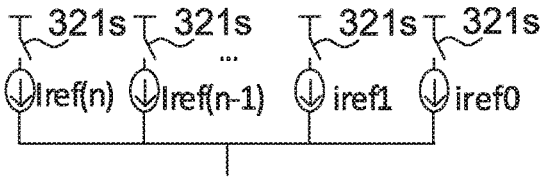
FIG. 11

BANDGAP REFERENCE CIRCUIT

RELATED APPLICATIONS

The present application is a continuation application of U.S. application Ser. No. 15/956,190, filed on Apr. 18, 2018, which is a continuation application of U.S. application Ser. No. 15/499,497, filed on Apr. 27, 2017, the disclosures of which are hereby incorporated by reference herein in their entirety.

BACKGROUND

1. Field of the Disclosure

This disclosure generally relates to a bandgap reference circuit and, more particularly, to a bandgap reference circuit that shuts down the bandgap reference voltage source thereof and provides a source voltage only by a clamp circuit in a suspend mode.

2. Description of the Related Art

FIG. 1 is a conventional power source circuit for providing a source voltage $V_{DD}$ required by a downstream circuit 15. The power source circuit includes a bandgap reference voltage source 11 and a regulator 13. The bandgap reference voltage source 11 provides a stable reference voltage Vref to the regulator 13. The regulator 13 has low static current Iddq to reduce the power consumption and is used to hold the source voltage $V_{DD}$. However, in a lower power mode, the regulator 13 still requires the power continuously provided by the bandgap reference voltage source 11 to generate the source voltage $V_{DD}$, such that significant power is still consumed in the low power mode. When this kind of power source circuit is applied to portable electronic devices, the standby time of the portable electronic devices is shortened.

FIG. 2 is another conventional power source circuit. Compared with the one shown in FIG. 1, the power source circuit in FIG. 2 further includes an operational amplifier 22 in addition to a bandgap reference voltage source 21 and a regulator 23. The operational amplifier 22 is used as a clamp circuit and to hold the source voltage $V_{DD}$ in a low power mode. In FIG. 2, although the operational amplifier 22 has low static current Iddq and the regulator 23 can be deactivated in the low power mode, the bandgap reference voltage source 21 still continuously operates in the low power mode.

In addition, in addition to having low static current Iddq (e.g., nano ampere range), the clamp circuit of a bandgap reference circuit has to fulfill the requirements of holding a stable source voltage, a small circuit area and working in an allowable voltage range.

Preferably, the clamp circuit of a bandgap reference circuit does not draw any power from a bandgap reference voltage source in the low power mode. However, it is not easy to achieve this purpose because when the bandgap reference voltage source for providing an accurate reference voltage Vref is shut down and if the reference voltage Vref has a 10% voltage variation, the source voltage $V_{DD}$ provided by the clamp circuit may change more than 10% to exceed the allowable working voltage range.

SUMMARY

One object of the present disclosure is to provide a bandgap reference circuit and an operation method thereof that perform the calibration in the normal mode.

To achieve the above object, the present disclosure provides a bandgap reference circuit including a bandgap reference voltage source, a clamp circuit and a calibration engine. The bandgap reference voltage source is configured to provide a bandgap voltage. The clamp circuit includes a reference generator and a plurality of clamp switches. The reference generator is configured to output a first reference voltage. The plurality of clamp switches is configured to determine the first reference voltage outputted by the reference generator. The calibration engine is coupled to the bandgap reference voltage source and a clamp voltage, and configured to control a combination of the plurality of clamp switches according to a voltage difference between the clamp voltage and the bandgap voltage.

The present disclosure further provides a bandgap reference circuit including a bandgap reference voltage source, a clamp circuit and a calibration engine. The bandgap reference voltage source is configured to provide a bandgap voltage. The clamp circuit includes a reference generator and a plurality of clamp switches. The reference generator is configured to output a first reference voltage. The plurality of clamp switches is configured to determine the first reference voltage outputted by the reference generator. The calibration engine is coupled to the bandgap reference voltage source and the reference generator, and configured to control a combination of the plurality of clamp switches according to a voltage difference between the first reference voltage and the bandgap voltage.

In the bandgap reference circuit of the present disclosure, diodes formed by the diode connected transistor are used as resistors to reduce an occupied area by the circuit. Although this kind of diodes is still influenced by the manufacturing process, the process variation is diminished after the calibration.

In the bandgap reference circuit of the present disclosure, as the bandgap reference voltage source and the regulator are shut down in the low power mode or suspend mode, the power consumption of the circuit is significantly reduced.

In the bandgap reference circuit of the present disclosure, as the comparator is used for once in the calibration mode and not used for comparison during most of the time, the comparator is sharable with other circuit functions to effectively utilize the circuit component.

In the bandgap reference circuit of the present disclosure, a source voltage is more accurately set and has a lower voltage variation in a suspend mode, the source voltage can be arranged at a lower level, e.g., 1 volt rather than 1.5 volts, to reduce the leakage current in the suspend mode.

In the bandgap reference circuit of the present disclosure, the calibration on the source voltage provided by the clamp circuit is automatically accomplished in the normal mode, and thus the wafer or chip level trimming is no longer required to effectively reduce the cost of testing and production.

The bandgap reference circuit of the present disclosure is preferably adapted to portable electronic devices that need to reduce the power consumption as much as possible, such as the cellphone, tablet computer and wireless mouse.

BRIEF DESCRIPTION OF THE DRAWINGS

Other objects, advantages, and novel features of the present disclosure will become more apparent from the following detailed description when taken in conjunction with the accompanying drawings.

FIG. 9 is the operating state of an operating method of a bandgap reference circuit according to one embodiment of the present disclosure.

FIG. 10 is a block diagram of a bandgap reference circuit according to an alternative embodiment of the present disclosure.

FIG. 11 is a current source bank of a reference generator of a clamp circuit according to one embodiment of the present disclosure.

DETAILED DESCRIPTION OF THE EMBODIMENT

It should be noted that, wherever possible, the same reference numbers will be used throughout the drawings to refer to the same or like parts.

Figure 1:
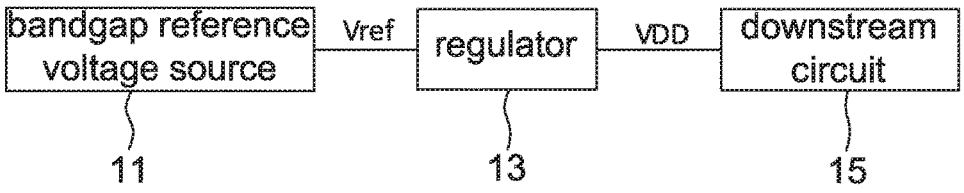
FIG. 1 (Prior Art)
FIG. 1 is a block diagram of a conventional power source circuit.
Figure 2:
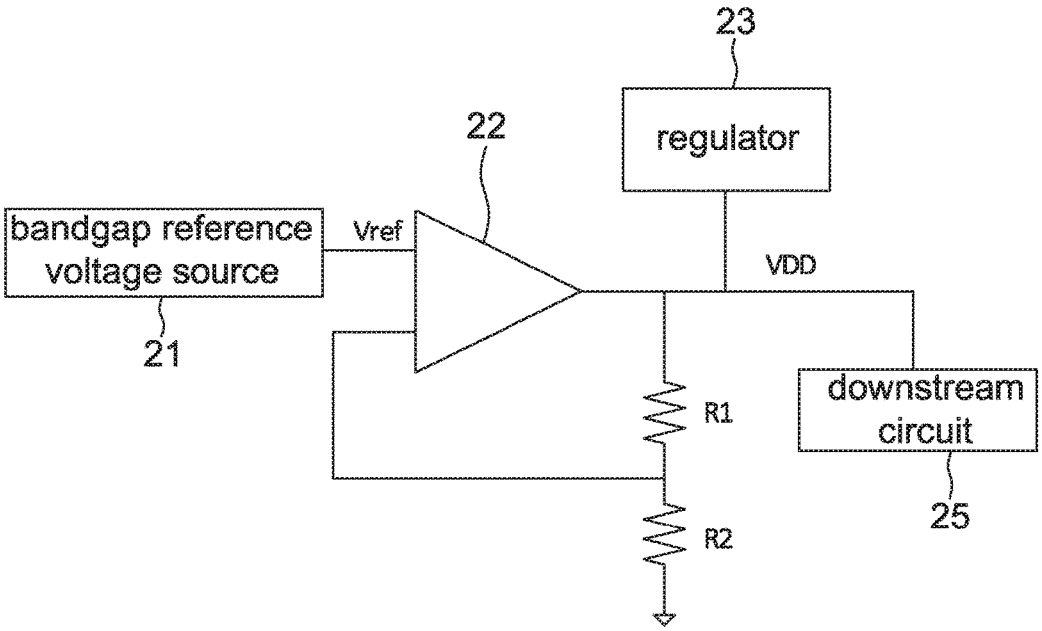
FIG. 2 (Prior Art)
FIG. 2 is a block diagram of another conventional power source circuit.
Figure 3:
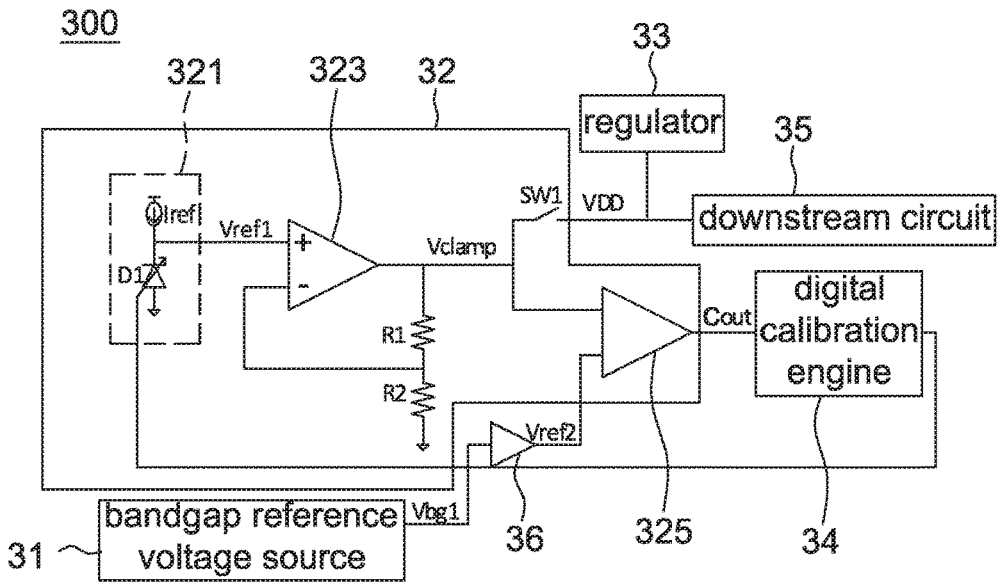
FIG. 3 is a block diagram of a bandgap reference circuit according to one embodiment of the present disclosure.

Referring to FIG. 3, it is a block diagram of a bandgap reference circuit 300 according to one embodiment of the present disclosure. The bandgap reference circuit 300 includes a bandgap reference voltage source 31, a clamp circuit 32, a regulator 33 and a digital calibration engine 34. The bandgap reference circuit 300 is used to provide a source voltage $V_{DD}$ to a downstream circuit 35, wherein the downstream circuit 35 includes, for example, a digital core. The source voltage $V_{DD}$ is, for example, smaller than or equal to 1 volt, but not limited to. If the calibration is performed properly, the source voltage $V_{DD}$ may be set at a lower voltage level.

In the embodiment of the present disclosure, as the calibrated clamp voltage Vclamp outputted by the clamp circuit 32 is almost equal to the desired source voltage $V_{DD}$ and has a small voltage variation, the downstream circuit 35 uses a lower source voltage $V_{DD}$. As the clamp circuit 32 is designed to have low power consumption, the leakage current is reduced by providing the source power $V_{DD}$ only by the clamp circuit 32 in a low power mode (or suspend mode).

The bandgap reference voltage source 31 is used to provide a bandgap voltage Vbg1 not sensitive to the process, voltage and temperature (PVT). The bandgap reference voltage source 31 also provides a reference voltage to other circuits, e.g., the regulator 33. The regulator 33 is coupled between the clamp circuit 32 and the downstream circuit 35, and used to hold the source voltage $V_{DD}$ firmly and not being influenced by loading current within a predetermined range. The regulator 33 may use a proper regulator without particular limitations as long as the used regulator operates in a normal mode and can be shut down in a low power mode.

The clamp circuit 32 includes a reference generator 321, an operational amplifier 323, a comparator 325, an output switch SW1, a feedback resistor R1 and a ground resistor R2, wherein the feedback resistor R1 and the ground resistor R2 are formed by transistors to reduce the circuit area.

Figure 4:
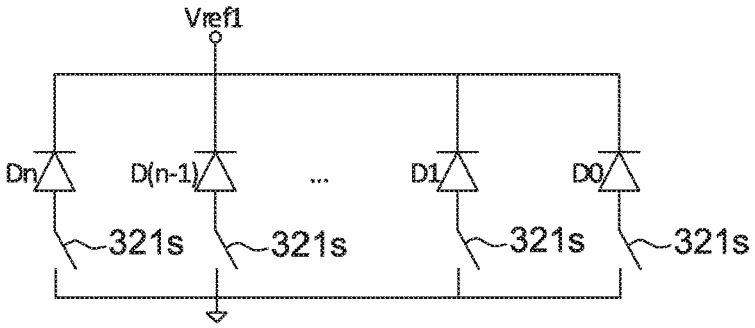
FIG. 4 is a partial circuit diagram of a reference generator of a clamp circuit according to one embodiment of the present disclosure.
Figure 5:
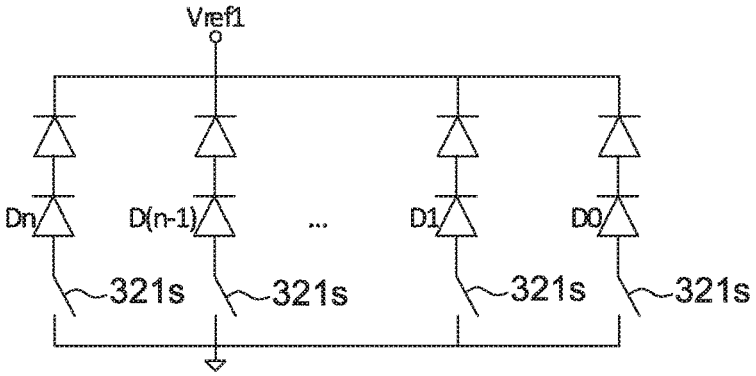
FIG. 5 is a partial circuit diagram of a reference generator of a clamp circuit according to another embodiment of the present disclosure.
Figure 6A:
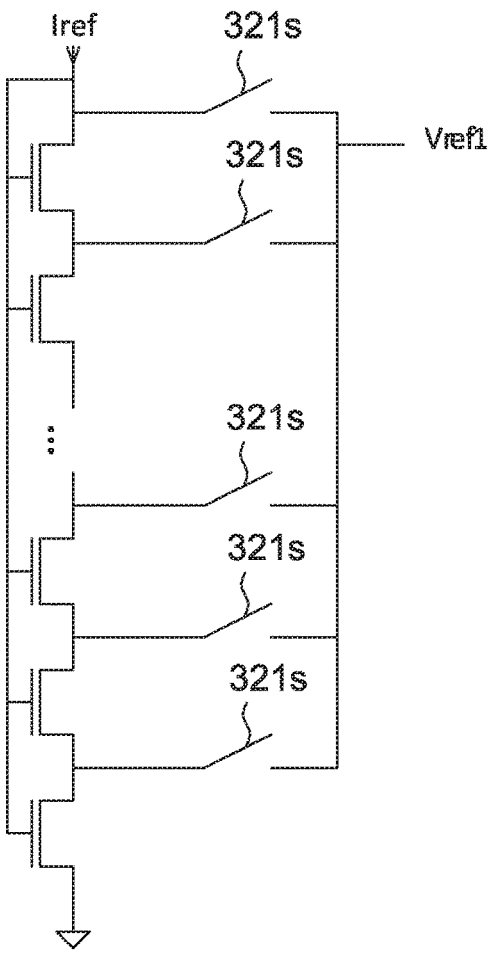
FIG. 6A is a partial circuit diagram of a reference generator of a clamp circuit according to an alternative embodiment of the present disclosure.
Figure 6B:
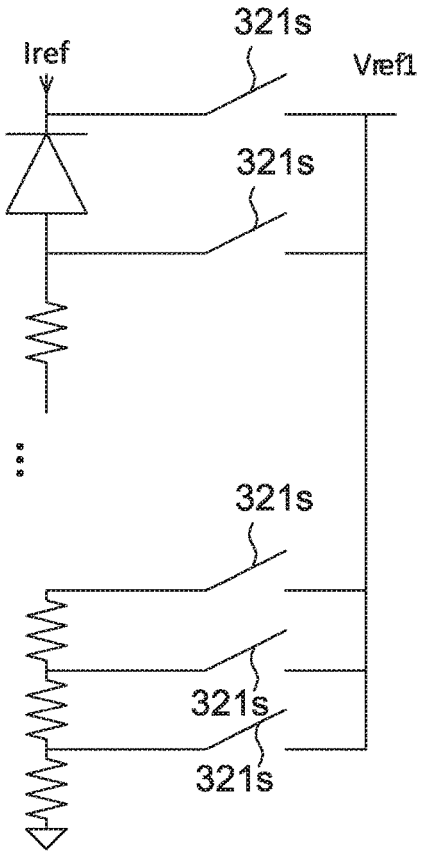
FIG. 6B is an equivalent circuit of FIG. 6A.

The reference generator 321 is used to generate an adjustable first reference voltage Vref1. In one embodiment, the reference generator 321 includes a reference current source and a diode bank D1. The reference current source is used to generate a reference current Iref to the diode bank D1, wherein the reference current Iref is preferably within a nano ampere range (e.g., 200 nA) and provided by a standard constant transconductance (Gm) circuit. The diode bank D1 is shown in FIGS. 4-5 for example, and each of the diodes D0-Dn (e.g., formed by diode connected transistor) or each of the serially connected diode groups D0'-Dn' has different width/length ratio from another and connects to one clamp switch 321*s*. By controlling different connection states of a plurality of clamp switches 321*s*, the first reference voltage Vref1 generated by the reference generator 321 is changeable. As each diode path is connected to ground, the diodes are not influenced by the voltage variation. In another embodiment, the reference generator 321 includes a reference current source and a transistor bank. The transistor bank is connected as shown in FIG. 6A, and FIG. 6B is an equivalent circuit of the transistor bank in FIG. 6A. Similarly, by controlling different connection states of a plurality of clamp switches 321*s*, the first reference voltage Vref1 generated by the reference generator 321 is changeable.

In the above embodiments, the diodes or transistors are used to replace the accurate resistors (e.g., poly resistors) such that the area occupied by the resistive circuit is reduced in the nano ampere range. It should be mentioned that the connections of the diodes, transistors and clamp switches 321*s* are not limited to those shown in FIGS. 4-6B. Their connection may be properly arranged without particular limitations as long as the first reference voltage Vref1 generated by the reference generator 321 is step-changed by changing the connection state of the clamp switches 321*s*.

The operational amplifier 323 has a positive input terminal (+), a negative input terminal (−) and an output terminal. The positive input terminal receives the first reference voltage Vref1 generated by the reference generator 321. The output terminal is feedback to the negative input terminal via the feedback resistor R1, and used to output a clamp voltage Vclamp. The ground resistor R2 is connected between the negative input terminal of the operational amplifier 323 and ground (e.g., FIG. 3 showing one end of the ground resistor R2 being connected to the ground and the other end being connected to the feedback resistor R1). The relationship between the clamp voltage Vclamp and the first reference voltage Vref1 is written as equation 1:

$$V\text{clamp}=V\text{ref1}\times(1+R1/R2) \qquad \text{equation 1}$$

The comparator 325 is used to compare the clamp voltage Vclamp with a second reference voltage Vref2 to generate a comparing output Cout, wherein the second reference voltage Vref2 is associated with the bandgap voltage Vbg1. In this embodiment, said second reference voltage Vref2 associated with the bandgap voltage Vbg1 is referred to that the second reference voltage Vref2 is equal to the bandgap voltage Vbg1 or the second reference voltage Vref2 is generated by an analog buffer 36, which is included in the bandgap reference circuit 300, from the bandgap voltage Vbg1. In other words, the bandgap reference circuit 300 of this embodiment may or may not include the analog buffer 36 according to the bandgap voltage Vbg1 provided by the bandgap reference voltage source 31 and the source voltage $V_{DD}$ to be provided.

In this embodiment, as the clamp voltage Vclamp is calibrated to be close to or equal to the second reference voltage Vref2 associated with the bandgap voltage Vbg1, which is not sensitive to PVT, the offset caused by the process and voltage variation is diminished. For example, although the reference current Iref and the diode bank D1 are still sensitive to the process and voltage variation, by adopting the calibration in the present disclosure, the variation thereof is removed. As for the variation caused by the temperature, it is very tiny compared with the offset due to the process.

The output switch SW1 is connected to the output terminal of the operational amplifier 323 and used to control the outputting of the clamp voltage Vclamp. That is, when the output switch SW1 is conducted, the clamp voltage Vclamp is outputted as the source voltage $V_{DD}$ to be provided to the downstream circuit 35; when the output switch SW1 is not conducted, the clamp voltage Vclamp is only compared with the second reference voltage Vref2 without being outputted. The output switch SW1, for example, receives a control signal from the downstream circuit 35 to be conducted in the low power mode but not conducted in other modes. The regulator 33 is coupled between the output switch SW1 and the downstream circuit 35.

The digital calibration engine 34 is used to adjust the first reference voltage Vref1 generated by the reference generator 321 according to the comparing output Cout to cause the clamp voltage Vclamp to have a smallest difference with respect to or be equal to the second reference voltage Vref2 (or the bandgap voltage Vbg1 when the analog buffer 36 is not implemented). The digital calibration engine 34 is, for example, a digital signal processor (DSP).

For example, in the embodiments of FIGS. 4-5, the digital calibration engine 34 changes the connection of the diode bank D1 by controlling the ON/OFF of the plurality of clamp switches 321*s* to adjust the first reference voltage Vref1 generated by the reference generator 321. In the embodiment of FIG. 6A, the digital calibration engine 34 changes the connection of the transistor bank by controlling the ON/OFF of the plurality of clamp switches 321*s* to adjust the first reference voltage Vref1 generated by the reference generator 321.

Figure 7:
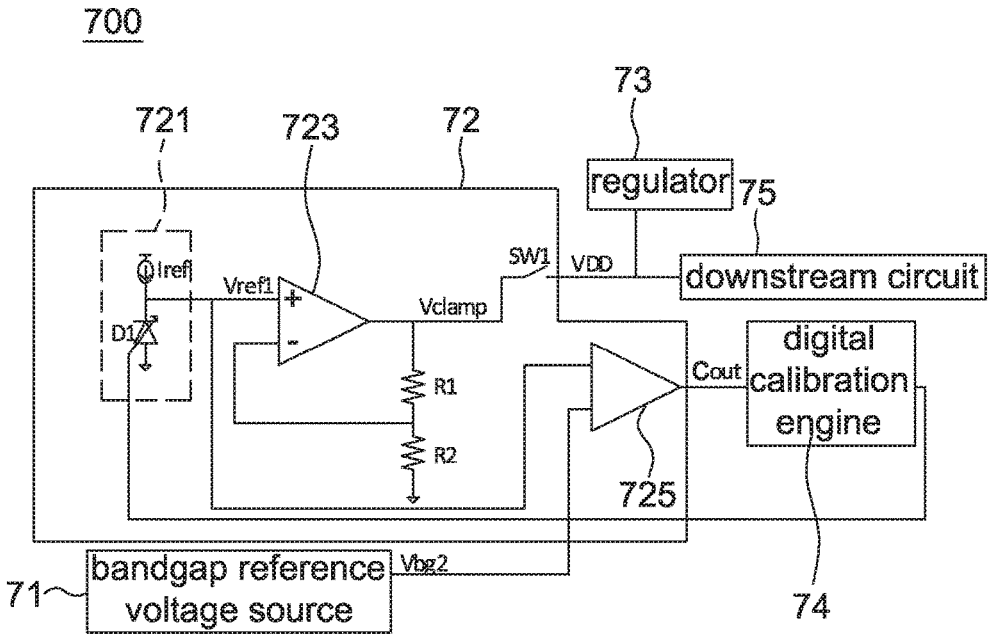
FIG. 7 is a block diagram of a bandgap reference circuit according to another embodiment of the present disclosure.

Referring to FIG. 7, it is a block diagram of a bandgap reference circuit 700 according to another embodiment of the present disclosure. The difference between the bandgap reference circuit 700 in FIG. 7 and the bandgap reference circuit 300 in FIG. 3 is at the voltages compared by the comparators 325 and 725. Functions of the bandgap reference voltage source 71, regulator 73, reference generator 721, operational amplifier 721, output switch SW1, feedback resistor R1 and ground resistor R2 are similar to the bandgap reference voltage source 31, regulator 33, reference generator 321, operational amplifier 321, output switch SW1, feedback resistor R1 and ground resistor R2 in FIG. 3, and are appreciated by one of ordinary skill in the art according to the descriptions of FIG. 3.

More specifically in FIG. 7, the comparator 725 is used to compare the first reference voltage Vref1 and a second reference voltage to output a comparing output Cout. In this embodiment, the second reference voltage is shown to be directly equal to the bandgap voltage Vbg2 outputted by the bandgap reference voltage source 71. As described in the above embodiment, FIG. 7 may further include an analog buffer (e.g., the element 36 in FIG. 3) used to convert the bandgap voltage Vbg2 to a different second reference voltage depending on a desired value of the source voltage $V_{DD}$. The digital calibration engine 74 is used to adjust the first reference voltage Vref1 generated by the reference generator 721 according to the comparing output Cout to cause the first reference voltage Vref1 to have a smallest difference with respect to or be equal to the second reference voltage (e.g., the bandgap voltage Vbg2). The method of adjusting the first reference voltage Vref1 is referred to FIGS. 3 to 6B.

If it is assumed that the source voltages $V_{DD}$ in FIGS. 3 and 7 are identical, FIG. 3 does not include the analog buffer 36, and the operational amplifiers 323 and 723 are ideal, the bandgap voltage Vbg2 is selected as Vbg1/(1+R1/R2).

Figure 8:
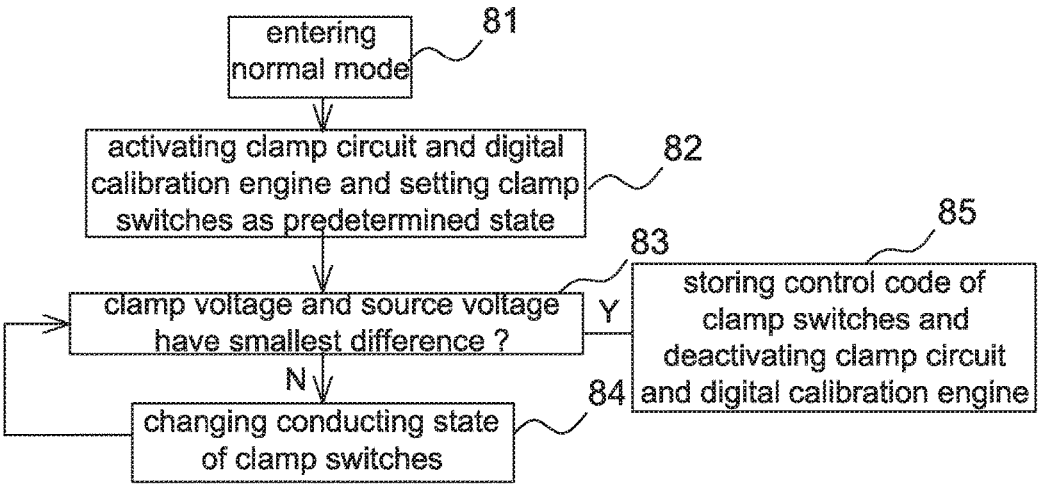
FIG. 8 is a flow chart of an operating method of a bandgap reference circuit according to one embodiment of the present disclosure.

Referring to FIG. 8, it is a flow chart of an operating method of a bandgap reference circuit according to one embodiment of the present disclosure, and the operating method is adaptable to the bandgap reference circuits 300 and 700 of FIGS. 3 and 7 (e.g., the bandgap reference circuit 300 in FIG. 3 being taken as an example for illustration hereinafter). As mentioned above, the bandgap reference circuit 300 includes a clamp circuit 32, a bandgap reference voltage source 31, a regulator 33 and a digital calibration engine 34. The clamp circuit 32 includes a plurality of clamp switches (e.g., clamp switches 321*s* in FIGS. 4-6B) for controlling a clamp voltage Vclamp outputted by the clamp circuit 32.

The operating method of this embodiment includes a normal mode, a calibration mode and a low power mode, wherein said normal mode is referred to that the power required by the downstream circuit 35 is provided by the bandgap reference voltage source 31 and the regulator 33 instead of by the clamp circuit 32; in said calibration mode, the power required by the downstream circuit 35 is still provided by the bandgap reference voltage source 31 and the regulator 33 only the digital calibration engine 34 stores the control code for controlling the reference generator 321; and said low power mode is referred to that the power required by the downstream circuit 35 is provided by the clamp circuit 32 instead of by the bandgap reference voltage source 31 and the regulator 33. Accordingly, in the low power mode, the bandgap reference circuit 300 consumes lower power than the conventional power source circuits.

The operating method of this embodiment includes the steps of: entering a normal mode, in which a clamp circuit is shut down and a digital calibration engine is idle (Step S81); entering a calibration mode, in which the clamp circuit and the digital calibration engine are activated, and a plurality of clamp switches are arranged as a predetermined conducting state (Step S82); in the calibration mode, adjusting, using the digital calibration engine, a conducting state of the plurality of clamp switches to obtain a smallest difference between the clamp voltage and a predetermined source voltage, (Step S83-84); storing, in the digital calibration engine, a control code of the plurality of clamp switches corresponding to the smallest difference, and deactivating the clamp circuit and idling the digital calibration engine to return to the normal mode (Step S85). In other words, the operating method of this embodiment enters the calibration mode once from the normal mode, and returns to the normal mode after the calibration mode is ended. Said one-time calibration is referred to that the digital calibration engine controls the plurality of clamp switches for one time to obtain the smallest difference or controls the plurality of clamp switches in a step-by-step manner for several times to obtain the smallest difference depending on actual operations. The digital calibration engine 34 controls the clamp switches in any suitable way as long as the smallest difference is obtainable.

In other embodiments, in facing the quick environmental change or long-term operation, said calibration mode is entered automatically every predetermined period of time. For example, the calibration mode is entered after the startup procedure accomplishes and the normal mode is entered after the calibration. Then the calibration mode is entered again every 30 or 60 minutes, but not limited thereto. Every time entering the calibration mode, the clamp switches are controlled to obtain a smallest difference between the clamp voltage and a predetermined source voltage. It is possible that values of the smallest difference obtained in the calibration modes entered at different times are different from each other due to different switching states of the clamp switches.

Referring to FIGS. 3 and 8-9 together, details of the operating method of this embodiment are described hereinafter.

Step S81: After the system is turned on, the bandgap reference circuit 300, for example, directly enters a normal mode to provide a source voltage $V_{DD}$ required by the downstream circuit 35. As shown in FIG. 9, in the normal mode, as the power required in the operation of the downstream circuit 35 is provided by the bandgap reference voltage source 31 and the regulator 33, the bandgap reference voltage source 31 and the regulator 33 are turned on; whereas, the clamp circuit 32 is shut down and the output switch SW1 is not conducted. The digital calibration engine 34 is in an idle state (i.e., only consuming leakage current) to hold the stored control code.

Step S82: In the normal mode, a calibration mode may be entered, e.g., receiving a control signal from the downstream circuit 35, automatically entered after the start-up, automatically entered every predetermined time interval (e.g., counted by a counter) or automatically entered every time a low power mode being ended. After entering the calibration mode, the reference generator 321, the operational amplifier 323 and the comparator 325 are powered up in order to operate. Then, the reference generator 321 starts to generate the reference current Iref and a plurality of clamp switches 321*s* therein is set at a predetermined conducting state. For example, the predetermined conducting state is set to cause the first reference voltage Vref1 outputted by the reference generator 321 to have a smallest value, a largest value, a middle value or other values among generable voltage values.

Step S83: The operational amplifier 323 amplifies the first reference voltage Vref1 to the clamp voltage Vclamp. The comparator 325 compares the clamp voltage Vclamp with the second reference voltage Vref2 (i.e. the voltage to be provided to the downstream circuit 35) to generate a comparing output Cout. The digital calibration engine 34 identifies whether the difference between the clamp voltage Vclamp and the second reference voltage Vref2 is smallest or not according to the comparing output Cout. If yes, the step S85 is entered; if not, the step S84 is entered. In other words, when the clamp voltage Vclamp and the second reference voltage Vref2 have a smallest difference therebetween, the clamp voltage Vclamp is closest to a predetermined source voltage $V_{DD}$ and has a smallest difference with respect to the predetermined source voltage $V_{DD}$.

Step S84: Then, the digital calibration engine 34 generates digital signals (e.g., 4 bits, 8 bits . . . ) to control the ON/OFF of the plurality of clamp switches 321*s* of the clamp circuit 321 to output different first reference voltages Vref1 (e.g., gradually increasing or decreasing the first reference voltage Vref1). Each connection state of the plurality of clamp switches 321*s* corresponds to one first reference voltage Vref1. The operational amplifier 323 amplifies the first reference voltage Vref1 to the clamp voltage Vclamp. When changing the connection of the plurality of clamp switches 321*s*, the digital calibration engine 34 identifies whether the clamp voltage Vclamp gradually approaches the second reference voltage Vref2 according to the comparing output Cout of the comparator 325. If the smallest difference is not reached, the steps S83 and S84 are repeatedly performed, and the step S85 is entered till the smallest difference is obtained.

Step S85: When a smallest difference is identified according to the comparing output Cout, the digital calibration engine 34 records the control code (e.g., digital code) at the same time, and sends a control signal to make the bandgap reference circuit 300 return to the normal mode. When the smallest difference is identified, the clamp circuit is deactivated and the digital calibration engine is idled to return to the normal mode.

As the clamp circuit 32 is not used to provide the source voltage $V_{DD}$ in both the normal mode and the calibration mode, the output switch SW1 is not conducted in both the normal mode and the calibration mode.

In the calibration mode, as the clamp circuit 32 and the digital calibration engine 34 are operated to store the control code, the clamp circuit 32 and the digital calibration engine 34 are turned on. Meanwhile, as the bandgap reference voltage source 31 and the regulator 33 still provides the source voltage $V_{DD}$, the bandgap reference voltage source 31 and the regulator 33 are turned on.

The operating method of this embodiment further includes the step of: entering a low power mode (e.g., an electronic device adopting the bandgap reference circuit 300 entering a sleep mode), in which as the clamp circuit 32 is used to provide the source voltage $V_{DD}$, the clamp circuit 32 is turned on and the output switch SW1 is conducted to output the clamp voltage Vclamp as the source voltage $V_{DD}$. Meanwhile, the digital calibration engine 34 controls the reference generator 321 using the control code stored in the calibration mode. The bandgap reference voltage source 31 and the regulator 33 are shut down to reduce the system power consumption in the low power mode.

When the above operating method is adapted to the bandgap reference circuit 700 in FIG. 7, the digital calibration engine 74 identifies whether a difference between the first reference voltage Vref1 and the second reference voltage (e.g., bandgap voltage Vbg2) reaches a smallest value, and records the control code of the plurality of clamp switches 321*s* corresponding to the smallest difference. In other words, when the difference between the first reference voltage Vref1 and the second reference voltage is smallest, the clamp voltage Vclamp is closest to a predetermined source voltage $V_{DD}$ and has a smallest difference value with respect to the predetermined source voltage $V_{DD}$. Details of other parts are similar to the above descriptions and thus not repeated herein.

In addition, it is possible to adjust the first reference voltage Vref1 generated by the reference generator 321 in other ways. For example referring to FIGS. 10-11, FIG. 10 is a block diagram of a bandgap reference circuit 300' according to an alternative embodiment of the present disclosure. The difference between the bandgap reference circuit 300' in FIG. 10 and the bandgap reference circuit 300 in FIG. 3 is at the way of changing the first reference voltage Vref1. In FIG. 3, a plurality of clamp switches 321*s* is used to change the connection of a plurality of diodes; whereas in FIG. 11, a plurality of clamp switches 321*s* is used to change the connection of a plurality of reference current sources iref0 to iref(n) so as to change the first reference voltage Vref1 generated by the reference generator 321', wherein iref0 to iref(n) respectively have different reference current values. In FIG. 10, the diode D1 is an unchanged diode. Functions of other elements in FIG. 10 and the operating method of FIG. 10 are similar to those of FIGS. 3 and 8 only a circuit structure of the reference generator 321' is changed. That is, these embodiments all adjust the generated first reference voltage Vref1 according to different connection states of a plurality of clamp switches 321*s*, and thus identical parts are not repeated herein.

More specifically, the clamp switches 321*s* of the clamp circuit 321 are used to control the connection of a diode bank (as FIGS. 4-5), a transistor bank (as FIGS. 6A-6B) or a current source bank (as FIG. 11).

In the operating method of the present disclosure, when the output switch SW1 is conducted, it means that a low power mode is entered, and thus the clamp circuit is turned on but the bandgap reference voltage source and the regulator are shut down. When the output switch SW1 is not conducted, it is possible that the normal mode or the calibration mode is entered; the bandgap reference voltage source and the regulator are turned on in both modes to provide source voltage $V_{DD}$ to the downstream circuit, and the clamp circuit is shut down in the normal mode but activated in the calibration mode. That is, the clamp circuit is turned only in the calibration mode but shut down in other time interval of the normal mode. The purpose of activating the clamp circuit is to allow the digital calibration engine to be able to store a control code for controlling the ON/OFF of the plurality of clamp switches 321*s* in the reference generator.

As mentioned above, as a bandgap reference voltage source of the conventional power source circuit still provides a stable source voltage in a low power mode, the power source circuit consumes significant power in the low power mode. Therefore, the present disclosure further provides a bandgap reference circuit (FIGS. 3, 7 and 10) and an operating method thereof (FIG. 8) that perform so called one-time calibration in the normal mode to store a control code of a plurality of clamp switches, and provides the source voltage only using a clamp circuit and shuts down the bandgap reference voltage source and the regulator in a low power mode to effectively reduce the total power consumption of the bandgap reference circuit.

Although the disclosure has been explained in relation to its preferred embodiment, it is not used to limit the disclosure. It is to be understood that many other possible modifications and variations can be made by those skilled in the art without departing from the spirit and scope of the disclosure as hereinafter claimed.

What is claimed is:

1. A bandgap reference circuit, comprising:

a bandgap reference voltage source configured to provide a bandgap voltage;

a clamp circuit, comprising:

a reference generator configured to output a first reference voltage; and a plurality of clamp switches configured to determine the first reference voltage outputted by the reference generator; and a calibration engine, coupled to the bandgap reference voltage source and a clamp voltage, and configured to control a combination of the plurality of clamp switches according to a voltage difference between the clamp voltage and the bandgap voltage.

2. The bandgap reference circuit as claimed in claim 1, wherein the reference generator comprises a reference current source and a diode bank, and the calibration engine is configured to control a conducting state of the plurality of clamp switches to change a connection of the diode bank.

3. The bandgap reference circuit as claimed in claim 1, wherein the reference generator comprises a reference current source and a transistor bank, and the calibration engine is configured to control a conducting state of the plurality of clamp switches to change a connection of the transistor bank.

4. The bandgap reference circuit as claimed in claim 1, wherein the reference generator comprises multiple reference current sources and one diode, and the calibration engine is configured to control a conducting state of the plurality of clamp switches to change a connection between the multiple reference current sources and the one diode.

5. The bandgap reference circuit as claimed in claim 1, wherein the clamp circuit further comprises an operational amplifier having a positive input terminal, a negative input terminal and an output terminal, the positive input terminal is configured to receive the first reference voltage, and the output terminal is feedback to the negative input terminal via a feedback resistor.

6. The bandgap reference circuit as claimed in claim 1, wherein the clamp circuit further comprises a comparator, which is coupled to the clamp voltage via one input thereof and coupled to the calibration engine via an output thereof.

7. The bandgap reference circuit as claimed in claim 6, further comprising an analog buffer coupled between the bandgap reference voltage source and another input of the comparator.

8. The bandgap reference circuit as claimed in claim 1, wherein the clamp circuit further comprises an output switch coupled in front of a downstream circuit.

9. The bandgap reference circuit as claimed in claim 8, further comprising a regulator coupled between the output switch and the downstream circuit.

10. The bandgap reference circuit as claimed in claim 9, wherein when the output switch is not conducted, the bandgap reference voltage source and the regulator are activated, and the clamp circuit is shut down in a normal mode but activated in a calibration mode.

11. A bandgap reference circuit, comprising:

a bandgap reference voltage source configured to provide a bandgap voltage;

a clamp circuit, comprising:

a reference generator configured to output a first reference voltage; and a plurality of clamp switches configured to determine the first reference voltage outputted by the reference generator; and a calibration engine, coupled to the bandgap reference voltage source and the reference generator, and configured to control a combination of the plurality of clamp switches according to a voltage difference between the first reference voltage and the bandgap voltage.

12. The bandgap reference circuit as claimed in claim 11, wherein the reference generator comprises a reference current source and a diode bank, and the calibration engine is configured to control a conducting state of the plurality of clamp switches to change a connection of the diode bank.

13. The bandgap reference circuit as claimed in claim 11, wherein the reference generator comprises a reference current source and a transistor bank, and the calibration engine is configured to control a conducting state of the plurality of clamp switches to change a connection of the transistor bank.

14. The bandgap reference circuit as claimed in claim 11, wherein the reference generator comprises multiple reference current sources and one diode, and the calibration engine is configured to control a conducting state of the plurality of clamp switches to change a connection between the multiple reference current sources and the one diode.

15. The bandgap reference circuit as claimed in claim 11, wherein the clamp circuit further comprises an operational amplifier having a positive input terminal, a negative input terminal and an output terminal, the positive input terminal is configured to receive the first reference voltage, and the output terminal is feedback to the negative input terminal via a feedback resistor.

16. The bandgap reference circuit as claimed in claim 11, wherein the clamp circuit further comprises a comparator, which is coupled to the reference generator via one input thereof and coupled to the calibration engine via an output thereof.

17. The bandgap reference circuit as claimed in claim 16, further comprising an analog buffer coupled between the bandgap reference voltage source and another input of the comparator.

18. The bandgap reference circuit as claimed in claim 11, wherein the clamp circuit further comprises an output switch coupled in front of a downstream circuit.

19. The bandgap reference circuit as claimed in claim 18, further comprising a regulator coupled between the output switch and the downstream circuit.

20. The bandgap reference circuit as claimed in claim 19, wherein when the output switch is not conducted, the bandgap reference voltage source and the regulator are activated, and the clamp circuit is shut down in a normal mode but activated in a calibration mode.

* * * * *